US006612816B1

(12) United States Patent
Vanden Brande et al.

(10) Patent No.: US 6,612,816 B1
(45) Date of Patent: Sep. 2, 2003

(54) MOLECULAR PUMP

(76) Inventors: Pierre Vanden Brande, 27, Vlierbeekberg, B-3090 Overijse (BE); Alain Weymeersch, 33, boîte 10, rue Charles Jaumotte, B-1300 Wavre (BE)

( * ) Notice: Subject to any disclaimer, the term of this patent is extended or adjusted under 35 U.S.C. 154(b) by 0 days.

(21) Appl. No.: 09/830,022

(22) PCT Filed: Oct. 15, 1999

(86) PCT No.: PCT/BE99/00127

§ 371 (c)(1),
(2), (4) Date: Nov. 15, 2001

(87) PCT Pub. No.: WO00/23715

PCT Pub. Date: Apr. 27, 2000

(30) Foreign Application Priority Data

Oct. 20, 1998 (EP) ..... 98203502

(51) Int. Cl.[7] ..... F04B 17/00; F04B 35/04
(52) U.S. Cl. ..... 417/410.1; 417/413.2
(58) Field of Search ..... 417/410.1, 322, 417/413.2, 436; 415/416

(56) References Cited

U.S. PATENT DOCUMENTS

| | | | | | |
|---|---|---|---|---|---|
| 3,374,941 | A | | 3/1968 | Okress | |
| 3,554,669 | A | | 1/1971 | Reader | |
| 4,498,851 | A | * | 2/1985 | Kolm et al. | 417/410.2 |
| 4,595,338 | A | * | 6/1986 | Kolm et al. | 416/81 |
| 4,780,062 | A | * | 10/1988 | Yamada et al. | 417/410.2 |
| 5,180,288 | A | | 1/1993 | Richter et al. | |
| 5,192,197 | A | * | 3/1993 | Culp | 417/322 |
| 5,759,015 | A | * | 6/1998 | Van Lintel et al. | 417/322 |
| 6,042,345 | A | * | 3/2000 | Bishop et al. | 417/322 |
| 6,071,087 | A | * | 6/2000 | Jalink et al. | 417/322 |
| 6,074,178 | A | * | 6/2000 | Bishop et al. | 417/322 |
| 6,106,245 | A | * | 8/2000 | Cabuz | 417/322 |

FOREIGN PATENT DOCUMENTS

| | | |
|---|---|---|
| DE | 39 25 749 C1 | 10/1990 |
| WO | WO 80 02445 A | 11/1980 |
| WO | WO 96 18823 A1 | 6/1996 |

* cited by examiner

*Primary Examiner*—Charles G. Freay
*Assistant Examiner*—William H. Rodriguez
(74) *Attorney, Agent, or Firm*—Browdy and Neimark, P.L.L.C.

(57) ABSTRACT

The invention concerns a molecular pump for evacuating a gas from a chamber, comprising a substantially sealed box (1) having on one of its sides an intake orifice (2) to be connected to said chamber and, on the opposite side, an outlet orifice (3), to be preferably connected to a discharge pump, whereby elements (4) are mounted between those two orifices (2) and (3) at some distance from one another in substantially fixed sites inside said box (1) for the gas to pass through, said elements (4) being of such a nature as to impart to said gas molecules, coming from said chamber and coming into contact with said elements (4), a speed whereof the resultant is oriented towards the outlet orifice (3).

20 Claims, 6 Drawing Sheets

MOLECULAR PUMP

BACKGROUND OF THE INVENTION

1. Technical Field of the Invention

The present invention concerns a molecular vacuum pump for evacuating a gas from a chamber, thereby generating a high vacuum which is generally situated between 0,1 mbar and $10^{-8}$ mbar and preferably between $10^{-2}$ and $10^{-6}$ mbar.

2. Prior Art

At present, when one wishes to maintain a pressure in the order of magnitude of $10^{-5}$ to $10^{-7}$ mbar, for example in order to evaporate a material under vacuum, or when it is necessary to maintain pressures in the order of magnitude of $10^{-2}$ to $10^{-5}$ when carrying out a plasma process for example, use is made of molecular pumps which can work under said pressure range. The required pressure of equilibrium is obtained by establishing the equilibrium between the inlet yield of the gases and the pump discharge of the system at a certain level. The pumping speed of the pump is generally fixed (volume per unit of time), the pressure is regulated by regulating the leakage rate in the vacuum chamber. It should be noted that when no gas is introduced, the pressure does not fall indefinitely, but it reaches what is called the limiting pressure of the system, resulting from the equilibrium between the leaks which are inherent to every installation and the speed of the installed pumping unit.

For the above-mentioned pressure range, two types of pumps are used in practice: what are called diffusion pumps on the one hand, based on the drag-in of the gas from the chamber in which the vacuum is to be created, by the ejection of gas by means of a series of concentric nozzles which are incorporated in the body of the pump, and molecular rotary entrainment pumps on the other hand (molecular turbopump and "molecular drag pump") which drag the gas molecules colliding with the rotor of the pump. Both types of pumps represent major disadvantages, however.

In a diffusion pump, as use is made of fluids to be evaporated such as hydrocarbons and silicones, whose vapours drive the pumping, problems arise in that the chamber in which the vacuum is to be created is contaminated due to the reverse diffusion of the vapours of the pump in the chamber. Moreover, large amounts of energy and water are consumed for the evaporation and condensation of said fluids. Further, a diffusion pump must be compressed to a large extent in order to be able to function at a pressure which is superior or equal to $10^{-3}$ mbar in the chamber, in order to avoid major pressure variations and an important contamination of the vacuum chamber. Generally, said compression strongly reduces the pumping speed of the pump.

Besides, a rotary molecular pump is only efficient when the rotational speed of the rotor is of the same order of magnitude as the speed at which the gas molecules are moved, which implies very high rotational speeds, generally situated between 30,000 and 80,000 revolutions per minute, depending on the size of the pump. Only at such rotational speeds can the far end of the rotor reach its maximum speed, which is in the order of magnitude of 500 m/sec for the best pumps. A speed increase is not easy to realise, given the mechanical difficulties which need to be overcome. At such speeds, the rotor, which is generally made of an aluminium alloy, is subjected to major stress conditions of up to 150 $N/mm^2$. Hence, it is very important, in order to prevent the rotor from crashing against the stator, that the rotor is perfectly positioned (to a $\mu$m) by means of advanced methods for dynamic balancing under vacuum at nominal speed. The tooling and especially the balancing thus represent a very high cost in the cost price of a rotary molecular pump. Of all the problems related to the use of a rotary molecular pump, we should mention in particular:

- the considerable wear of the mechanical bearings usually makes it necessary to use magnetic or gas bearings, which are very expensive;
- when mechanical bearings are used, the use of lubricant may result in a contamination of the chamber which, although it is negligible compared to with what is obtained with a diffusion pump, may be critical in certain applications;
- when there is a magnetic field superior to 10 mT, the use of rotary molecular pumps with a conductive rotor is seriously complicated by the presence of induced currents which will overheat the latter;
- increasing the pumping speed of this type of pump is difficult and expensive above 5000 l/sec because of the equipment which is required for tooling and balancing these pumps.

OBJECT AND SUMMARY OF THE INVENTION

The present invention mainly aims to provide a molecular pump which makes it possible to remedy the disadvantages of the existing pumps of this type.

To this end, the pump according to the invention comprises a substantially sealed box having on one of its sides an intake orifice to be connected to said chamber and, on the opposite side, an outlet orifice, to be preferably connected to a discharge pump, whereby elements are mounted between those two orifices at some distance from one another in substantially fixed sites inside said box for the gas to pass through, said elements being of such a nature as to impart to said gas molecules, coming from said chamber and coming into contact with said elements, a speed whereof the resultant is oriented towards the outlet orifice.

Advantageously, said elements work in conjunction with means which make it possible to subject them to a vibration having a component which is directed towards the outlet orifice.

According to a preferred embodiment of the pump according to the invention, the above-mentioned element contains a piezo-electric material fixed on the above-mentioned support and coated, on the side opposite to the one which is directed towards the support, with an electrically conductive coating, whereby means are provided to apply an alternating current to said element, such that said piezo-electric material is subjected to a deformation in a direction transversal to the support and, consequently, said coating is exposed to a corresponding vibration.

Other particularities and advantages of the pump according to the invention will become clear from the following description, in which some particular embodiments of this pump are represented as an example only and without being limitative in any way, with reference to the accompanying drawings.

DETAILED DESCRIPTION OF THE PREFERRED EMBODIMENTS OF THE INVENTION

In the different figures, the same reference figures refer to analogous or identical parts.

The invention concerns a new type of vacuum pump, mainly designed for pumping in a pressure zone situated between 0,1 mbar and $10^{-8}$ mbar. Thus, it is a pump operating in what is called a molecular mode, i.e. a pump in which the collisions of the molecules with the walls of the pump strongly dominate the collisions between the molecules.

Figure 1:
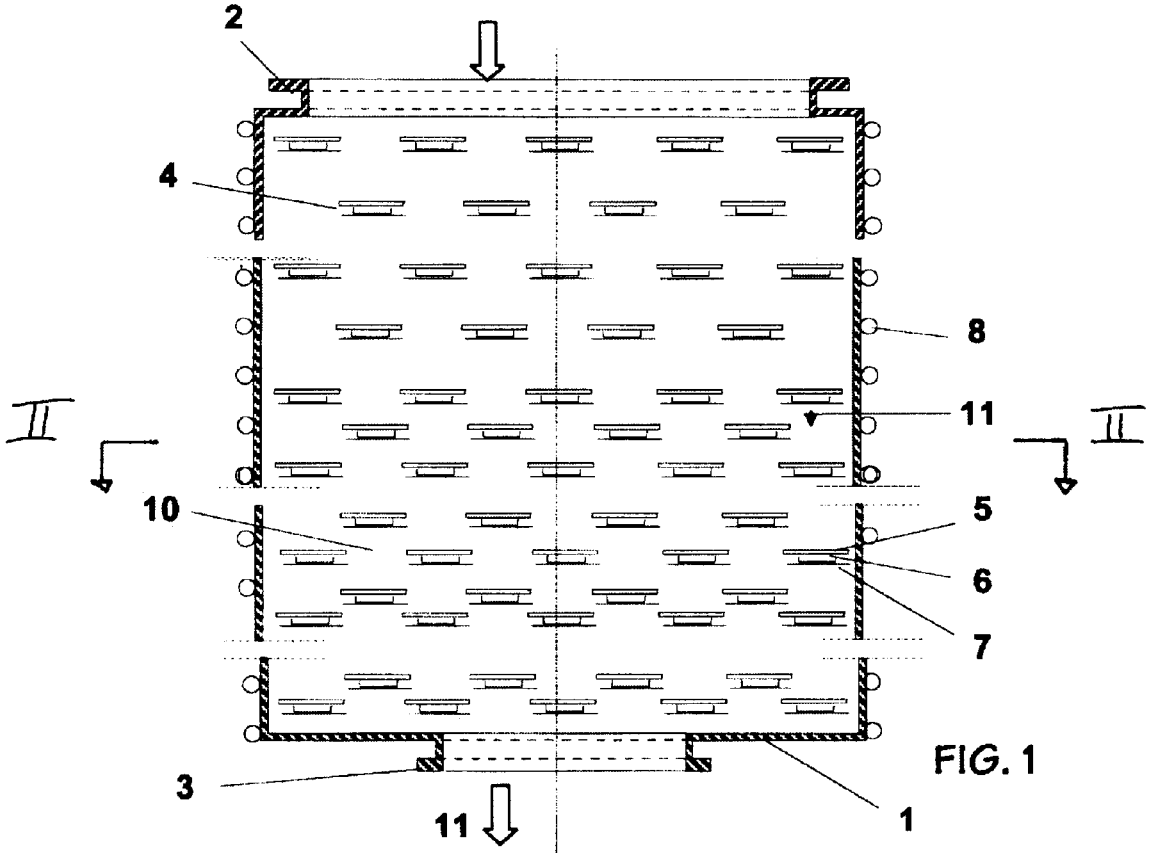
FIG. 1 schematically represents a first embodiment of the pump according to the invention, seen as a longitudinal section according to line I—I of FIG. 2, with partial cut-outs.
Figure 2:
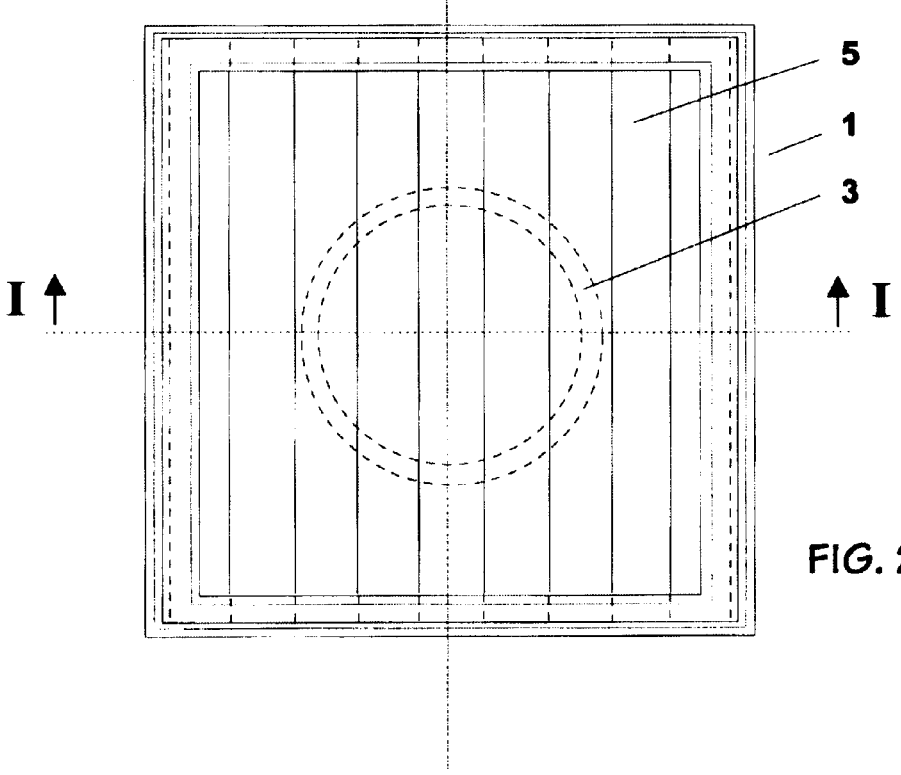
FIG. 2 is a cross section according to line II—II of FIG. 1.

A first embodiment of such a pump is represented in FIGS. 1 and 2. It comprises a sealed metal box or casing 1 having on one of its sides an intake orifice 2 to be connected to a chamber which is not represented here, in which is to be created a high vacuum. An outlet orifice 3 designed to be connected to a discharge pump, which is not represented either, is provided on the opposite side of said box 1.

Inside the box 1 are provided a series of acceleration elements 4 which extend between said two orifices 2 and 3, at a certain distance from one another, in fixed places and in between which are provided passages 10 for the gas to be evacuated.

According to the invention, these elements 4 are of such a nature as to impart to said gas molecules, coming from said chamber and coming into contact with the elements 4, a speed whereof the resultant is oriented towards the outlet orifice 3.

These elements 4 form the active parts of the pump and they are provided at successive levels. They make it possible to pump the gas as of the intake orifice 2 towards the outlet orifice 3 by increasing the gas pressure level by level. This is made possible by subjecting the gas molecules at each level to a deceleration sequence, followed by an acceleration by means of the elements 4 of the latter towards the elements of the next level.

Thus, the molecular pump according to the invention must have a high pumping speed at the levels near the intake orifice 2 and a lower pumping speed at the levels near the outlet orifice 3, where the pressure will consequently be higher.

When the pump is running idle, the mass flow rate is constant at each level of the pump, i.e. the product of the pumping speed and the pressure is constant from one level to another.

In order to make it possible to increase the gas pressure from one level to another, the pumping speed will have to proportionally decrease, which is realised in practice by providing a cross section of flow in the passage 10 for the gas from one level to another which decreases towards the outlet orifice 3.

For this reason, according to the invention, what are called the "high pressure" pump levels which are thus situated near the outlet orifice 3 are pressed closer together than what are called the "low pressure" pump levels situated near the intake orifice 2.

Advantageously, the above-mentioned elements 4 are mounted on a fixed support 5, on the side of the latter, directed towards the above-mentioned outlet orifice 3, and they are realised such that they can co-operate with means 9 which make it possible to subject them to a vibration having a component directed towards the outlet orifice 3.

Moreover, means are provided to maintain the above-mentioned support 5 at a considerably low temperature, for example the ambient temperature.

To this end, the support 5 and the box 1 are made of a caloric material, namely metal, and they are connected to a cooling circuit 8 which is fed for example by the water surrounding the box 1, in such a way that the heat is conducted between them.

Each element 4 contains a vibrating organ 6 which, in the embodiment represented in FIG. 1, consists of a layer of piezo-electric material fixed to the metal support 5 and which is coated, on the side opposite to the one which is directed towards the support 5, by a coating formed of an electrically conductive material 7.

Means 9, formed of an alternating current generator, which is in particular sinusoidal, are provided in order to make it possible to make the layer of piezo-electric material 6 undergo a deformation according to a direction which is transversal to the support 5 and, as a consequence, to subject the above-mentioned coating 7 to a corresponding vibration.

The coating surface 7 which is subjected to said transversal vibration thus imparts a speed to the gas molecules, mainly in the pumping direction, and in fact plays the role of the rotor of a turbomolecular pump.

In order to provide a good compression ratio to the pumping, the thus excited molecules have to be slowed down before they go from one level to a following level, where they are again accelerated. Said deceleration is obtained when the excited molecules collide with the parts of the support 5 which are not subjected to a vibration and which are maintained at a relatively low temperature, as mentioned above. This support 5 thus functions as the stator of a turbomolecular pump.

In order to make the molecular pump according to the invention operate with a maximum yield, the support 5 must be fixed in relation to the supporting structure of the pump, i.e. in relation to the box 1 of the latter, whereas only the surface 7 can be subjected to a transversal vibration due to the effect of the intermediary layer 6 which is preferably made of a piezo-electric material.

The frequency and amplitude of the vibration are related in that the speed of movement of the surface 7 must at least reach a speed in the order of what is called the "thermal" velocity of the gas molecules under the pumping conditions.

Thus, in order to pump nitrogen at a temperature in the order of 25° C., a velocity in the order of 500 m/sec must advantageously be reached. This corresponds to a pulsation of 500 krad/sec for an amplitude of 1 mm, a pulsation of 5 rad/sec for an amplitude of 100 $\mu$m or also a pulsation of 50 Mrad/sec for an amplitude of 10 $\mu$m.

Depending on the pulsation (which comes down to the frequency) and the amplitude of the movement of the vibrating surface 7, the working principle may vary.

Instead of being formed of a piezo-electric material, the vibrating organ 6 could, for example, be a magnetic vibrator device containing an electromagnet or an electrostatic device in which the support 5 and the surface 7 together form a capacitor subjected to an alternating current or also magnetostriction transducer.

However, if there is an intermediate layer 6 between the support 5 and the surface 7 made of piezo-electric material, as is the case for example in the embodiment represented in FIGS. 1 and 2, relatively high frequencies can be obtained for example at the resonance frequency of this piezoelectric material. In this way, it is possible to obtain frequencies in the order of magnitude of 20 MHz with zirconates and lead titanates (PZT) as piezo-electric materials, whereas frequencies of over 100 MHz can be obtained with copolymers of the type of PVDF.

According to the invention, the polymer piezo-electric materials and in particular the above-mentioned polymers are particularly interesting in that their weak specific sound impedance ($4.10^6$ $kgm^{-2}s^{-1}$) and their low density make it possible to make the surface 7 vibrate without imparting this vibration to the support 5 which is maintained at a relatively low temperature.

As already mentioned above, following the pressure increase of the gas which is pumped towards the outlet orifice 3, the cross section of flow in the passage 10 must be adjusted level by level as well as the distance between the successive levels in order to conform to the decrease of the average free path between the elastic collision of the pumped molecules, if we want to preserve the molecular velocity.

For example, with a nitrogen pressure which is superior or equal to 0,001 mbar, the characteristic dimension between two levels is preferably a few centimeters at the most, whereas, for a pressure of 0,01 mbar, this dimension is only a few mm and it will be even less for a pressure in the order of magnitude 0.1 mbar.

For this reason, among others, different types of geometry and of disposition of the supports and vibrating elements 4 can be taken into account to realise the different pump levels.

First of all, as far as the first embodiment is concerned as represented in FIGS. 1 and 2, which forms one of the preferred configurations, the sealed box 1, in which the vibrating elements 4 are provided, represents a transversal square or rectangular section, as is clearly represented in FIG. 2, and the metal supports 5 are provided in the successive levels and in a staggered manner in said box. These supports are formed of blades which extend parallel in relation to one another between two opposite walls of the box 1. Thus, the blades forming the supports 5 are cooled as a result of the thermal contact with said walls of the box 1. These blades are situated at planes which are parallel in relation to one another, whereby each plane defines a level. At each level, the blades are situated at a certain distance from one another in order to allow the gas to pass from one level to another.

Figure 3:
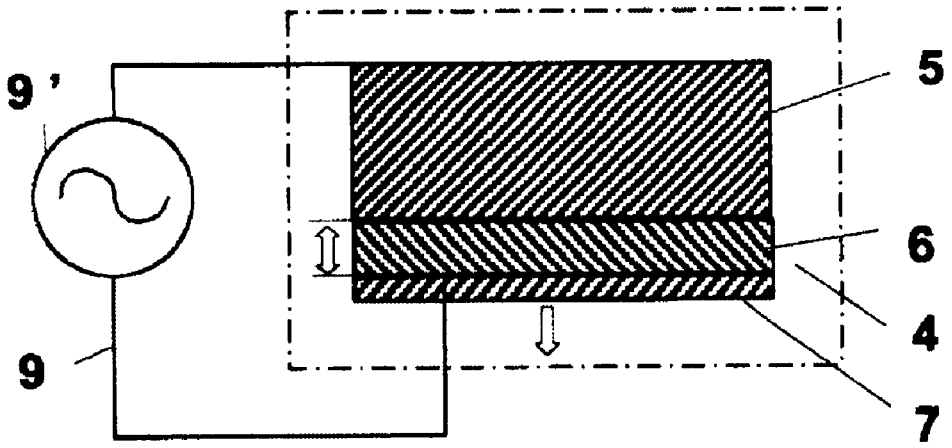
FIG. 3 represents a cross section, to a larger scale, of a major part of the pump according to the first embodiment.
Figure 4:
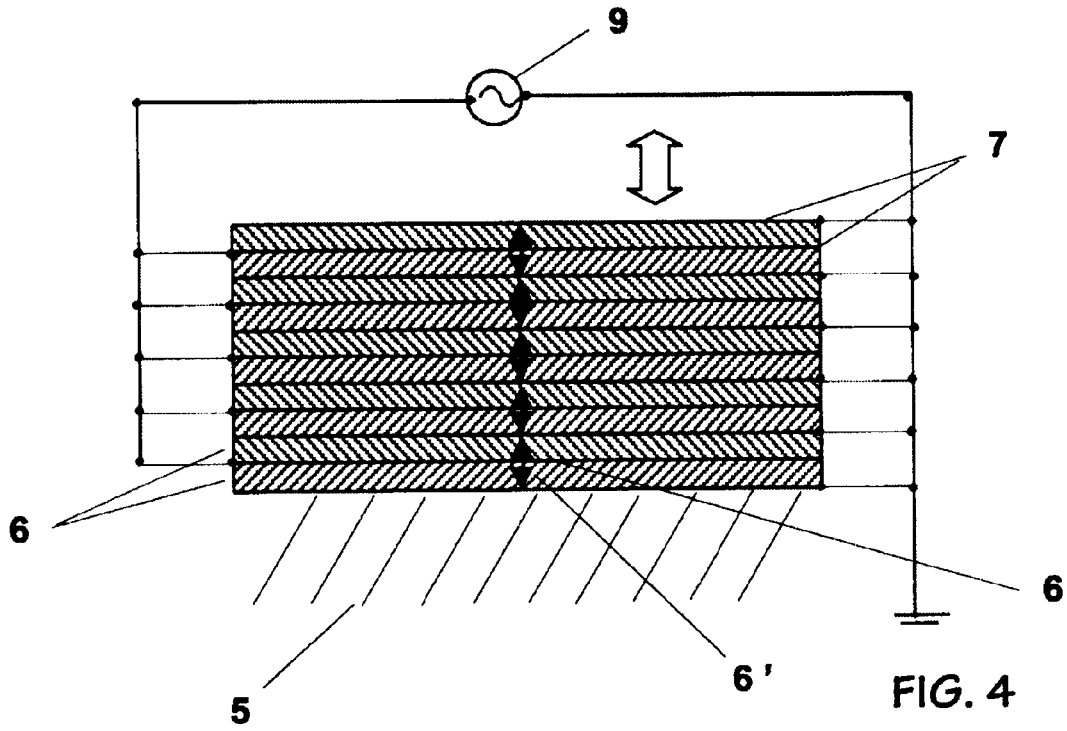
FIG. 4 represents a variant of the embodiment represented in FIG. 3.

The lower side of each of the supporting blades 5 is coated with a piezo-electric PVDF film which is connected to an oscillating circuit 9, as shown in greater detail in FIGS. 3 and 4, which makes it possible to make said film vibrate, preferably at a frequency which is close to the resonance frequency.

As a result of its low density and its weak specific sound impedance compared to those of the supporting blade 5, the free surface of the PVDF film starts to vibrate, whereas the support remains immobile. This surface is coated with a metal coating 7 allowing for the polarisation of the film and thus transferring kinetic energy to the gas molecules and atoms, which are adsorbed therein, in the cross direction in relation to this coating 7 and in the direction of the outlet orifice 3, i.e. the pumping direction, as indicated by arrow 11.

As already mentioned above, the PVDF film is electrically excited by means of an oscillating circuit. In the embodiment shown in FIG. 3, this oscillating circuit comprises an alternating current generator 9' which is connected to the conductive coating 7 provided on the piezoelectric film 6 on the one hand, and to the metal support 5 on the other hand.

In the embodiment shown in FIG. 4, the initial direction of polarisation of the piezo-electric material 6, represented by arrow 6', is inverted from one level to another. The layers 6 are coated with an electrically conductive film 7 which makes it possible to connect them independently from one another to the earthing and to an alternating current generator 9. This configuration represents a serious advantage as it allows to:

- maintain the support 5 to the earthing, as well as the external surface 7 which imparts the vibrations to the molecules;
- for an applied electric field with a specific value, this configuration makes it possible to work with lower nominal tensions for active thicknesses which are theoretically as high as necessary, since the field is applied in the successive layers;
- further, this configuration makes it possible to work with any active thickness whatsoever at high frequencies which are close to the resonance frequency of the composing layers 6, since the resonance frequency increases when the thickness of a layer 6 decreases.

The PVDF film can either be in direct contact with the support 5 if the latter is electrically conductive, or, if the support 5 is not electrically conductive, it can be first coated with a conductive film.

Figure 5:
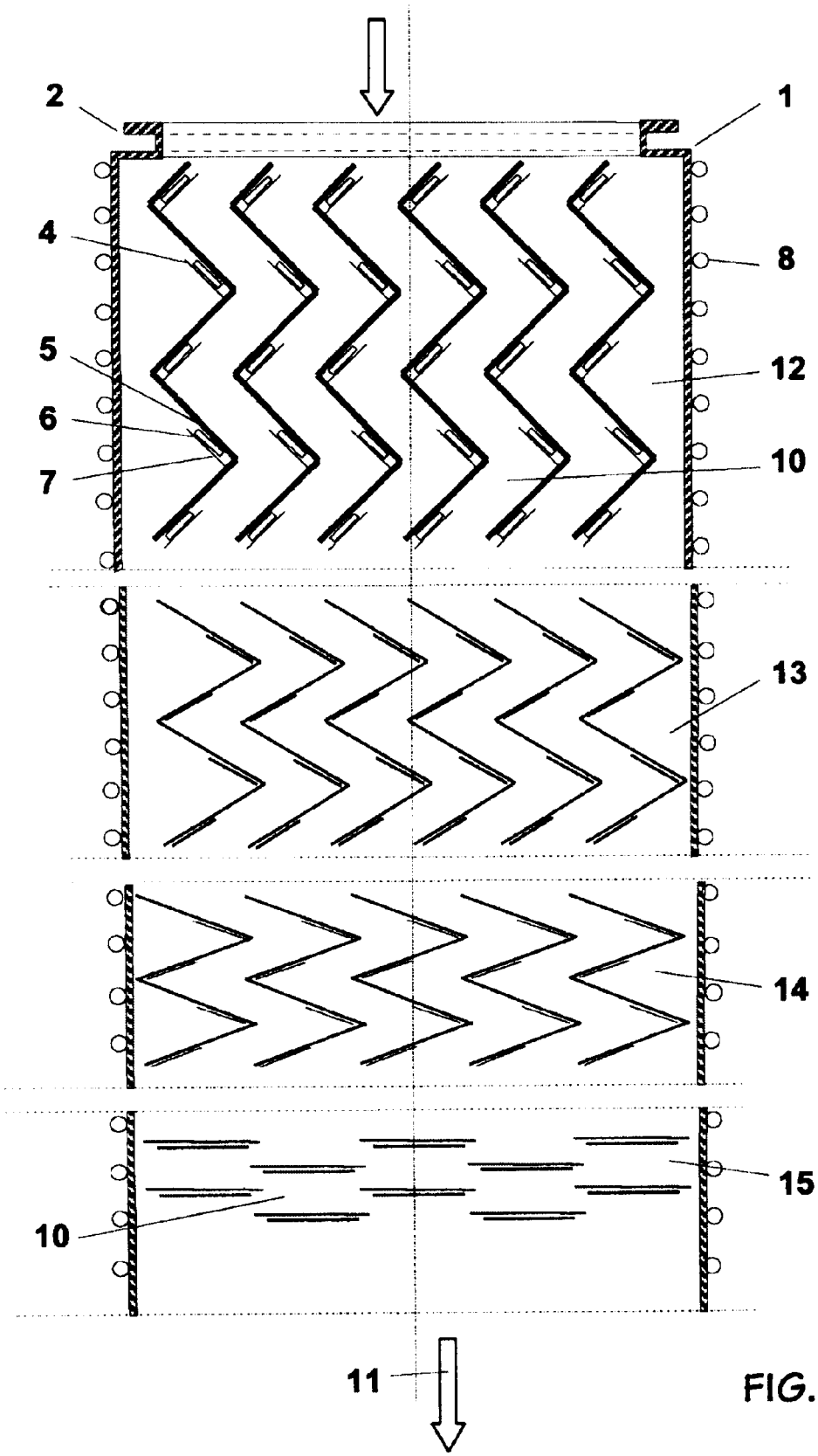
FIG. 5 schematically represents a longitudinal section analogous to that of FIG. 1 for a second embodiment of the pump according to the invention.

FIG. 5 represents a second embodiment of a preferred configuration of the vibrating elements 4 in the box 1.

In this configuration, the first levels of the pump, i.e. close to the intake orifice 2, are inclined in relation to the longitudinal axis of the box 1 at an angle in the order of magnitude of 45° in order to accelerate the pumping speed.

In the subsequent zones of the box 1, this angle is more and more reduced, such that the levels are pressed closer together, to become horizontal near the outlet orifice 3. The reason for this, as already explained above, is that, at the start, the pump discharge is relatively high for a relatively low pressure, whereby the pumping speed diminishes and the pressure increases as we go further in the box, since the mass flow rate remains the same at all levels when the pump is running idle.

In FIG. 5 are represented four level zones 12, 13, 14 and 15. At each level, the supports are mounted in a specific position.

Figure 6:
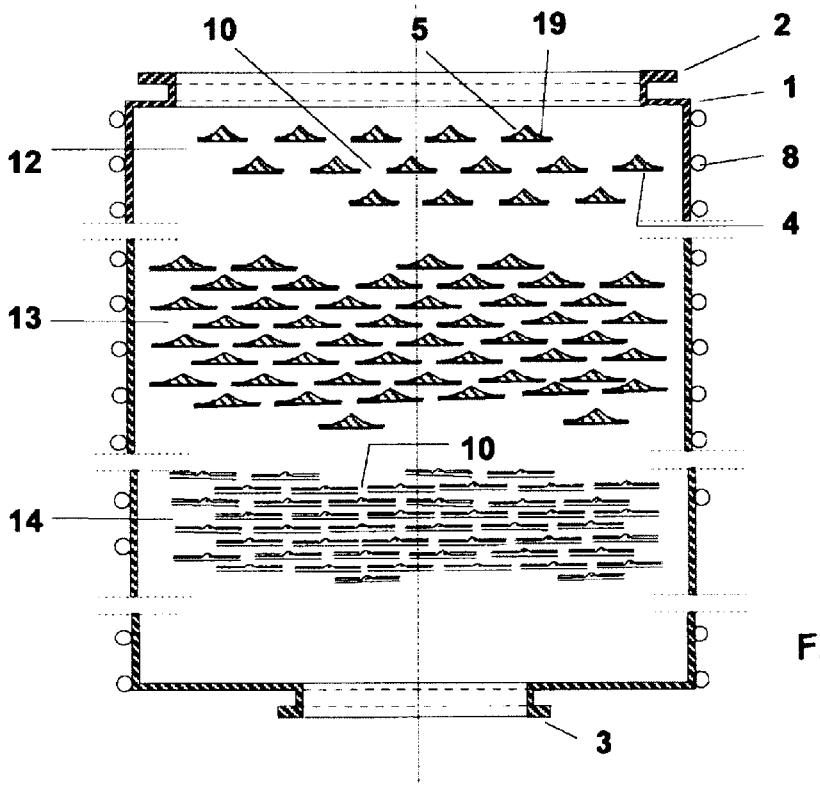
FIG. 6 schematically represents a view analogous to FIGS. 1 and 5 of a second embodiment of the pump according to the invention.
Figure 7:
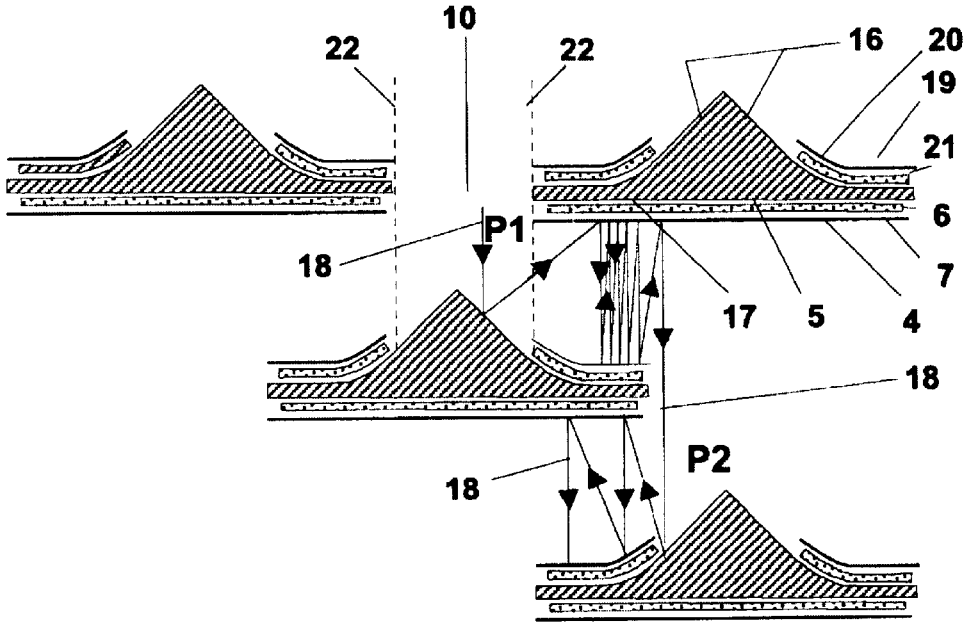
FIG. 7 represents a part of FIG. 6 in detail and to a larger scale.

FIG. 6 refers to a third preferred configuration as far as the shape and disposition of the supports 5 and the vibrating elements 4 are concerned. FIG. 7 represents a detail of this figure.

In zone 12, near the intake orifice 2, the supports 5 are provided in a staggered manner and they represent a cross section which strongly resembles an isosceles triangle whose top is directed towards the intake orifice 2. As is shown more clearly in FIG. 7, the inclination of the oblique sides 16 of these supports allows for a maximum reflection of the gas molecules which hit these sides towards the basis 17 of the supports which are equipped with the vibrating element 7, as indicated by the arrows 18. Moreover, in this first zone 12, the distance between the supports 5 is as large as possible in order to create a maximum passage 10 for the molecules which are thrown back by one level to the following level of vibrating elements. In the following zones, the levels come closer to one another and the cross sections of flow in the passage 10 become narrower. Moreover, also the height of the triangular supports 5 diminishes and the oblique sides 16 represent a concave form whose curve is fixed as a function of the opening of the passage 10, such that a maximum amount of molecules are transferred to the following level.

An important particularity of the configuration represented in FIGS. 6 and 7 is the presence of vibrating elements 19 analogous to the elements 4 which partially cover the oblique sides 16 of the supports 5. Thus, the elements 19 are formed of an intermediate layer 21, preferably made of a piezo-electric material covered with a conductive coating 20, and they partially face the elements 4 of the preceding level. These elements 19 make it possible to transfer kinetic energy to the molecules during a course of successive collisions with vibrating elements rather than during the course of a single collision, whereby the molecules are properly led to the passage 10, giving them access to the next level. At this next level, the kinetic energy of the excited molecules diminishes during their collisions with the parts of the oblique sides 16 which are not covered by the elements 19, which thus makes the pressure rise at this level (P2) in relation to the pressure prevailing at the preceding level (P1).

These non-covered parts of the supports of a particular level preferably correspond to the projection of the surface of the passage 10 between two successive supports of the preceding level onto the oblique sides 16 of the supports of that particular level. This is indicated in FIG. 7 by the projection lines 22.

The major advantage of this configuration is that it allows to transfer the kinetic energy required to pump the molecules in different stages, which has as a practical consequence that it is possible to operate with product values of the pulsation and the amplitude of the vibration which are lower than 500 m/sec.

Thus, it is possible to increase the compression ratio from one level to the next, which can be compared to using supports having a purely triangular section.

Other configuration variants for the supports 5 and vibrating elements 4 are not excluded.

Thus, the base of the triangle could have the shape of a curve, but it could just as well be concave or convex. Moreover, the vibrating element 4 could possibly undergo, during its vibration, a reinforced deformation and be alternately transformed from a concave or flat shape into a convex or concave shape, such that the amplitude of the vibration increases. In such a variant, the vibrating element could be formed of a flexible blade, held in the support 5 by its two far ends, such that it can undergo, as a result of the effect of the oscillating circuit 9, a deformation from a relatively flat position, when in a condition of rest, into a curved position, in the excited state, as shown in FIG. 8.

According to yet another configuration, the vibrating element 4 could be formed of a piezo-electric blade fixed in one point 23 to the support 5 and undergo, as a result of the effect of the oscillating circuit 9, a transformation between a rest position and a deformed position, more or less in the same manner as a bimetal. Such a variant is illustrated in FIG. 9.

Figure 8:
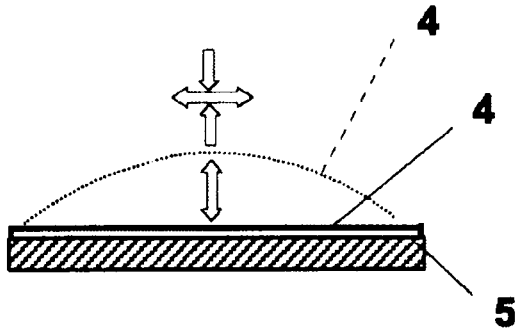
FIG. 8 represents a detail of a first variant of the embodiments according to the preceding figures.
Figure 9:
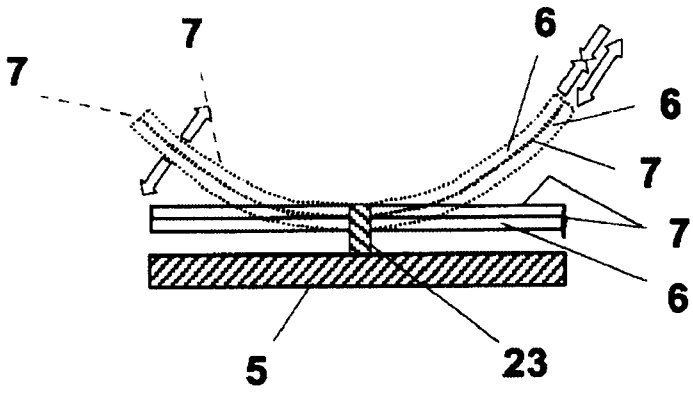
FIG. 9 represents a detail of a second variant of the embodiments according to the preceding figures.

In these FIGS. 8 and 9, the position in the excited state is represented by means of a dashed line.

Hereafter is given a practical example which makes it possible to further illustrate the aim of the present invention.

This example concerns a molecular pump of the type as represented in FIG. 6 and it comprises 30 horizontal levels placed on top of one another, in which the supports 5 of the vibrating elements 4 are mounted in a staggering manner. Each of these supports 5 represents the following cross dimensions: 700 mm×15 mm, and they are provided in a box having a rectangular horizontal section of 700 mm×600 mm.

Every level consists of 20 rectangular supports 5 having a triangular shape and provided in a manner similar to that in FIG. 6.

Moreover, the elements can be formed of all sorts of means.

Thus, according to the invention, it is sufficient to create a series of dipoles directed from the intake orifice towards the outlet orifice in the sealed box of the pump. In the above-described embodiments, the dipole was formed of a fixed part and a vibrating part. One could also take a bipole formed of a cold part and a warm part, separated from one another by means of an insulating material.

Finally, the box 1 can be placed in different positions, for example with the intake orifice 2 directed towards the bottom or towards the side.

This box 1 could thus have other shapes than a prismatic one. It could for example have a cylindrical shape with a circular section.

These supports 5 are cooled as a result of the thermal contact with the side walls of the box 1 of the pump, which is cooled itself by a water circuit 8.

On the bottom side 17 of the supports is fixed a PVDF film 6 which partially faces the PVDF films 20 which are fixed on a part of the sides 16 of the supports 5 of the following level. The piezo-electric films which are excited at a frequency close to their resonance frequency in the order of magnitude of 10 MHz make it possible to obtain a compression ratio of 2 from one level to another of the pump for a gas formed of nitrogen. Thus can be obtained a maximum compression ratio of $10^9$ for the above-mentioned 30 levels of the pump. The nominal pumping speed amounts to 24,000 l/sec for nitrogen at 25° C., and the maximum mass flow rate which is reached is 24 mbar.liter.sec$^{-1}$ or 86,4 mbar.m$^3$/h.

For a nitrogen pressure measured on the intake orifice 2 and amounting to $5.10^{-3}$ mbar, a pressure in the order of magnitude of 0.03 mbar is observed on the outlet orifice 3, onto which is connected a discharge pump formed of a "Roots" pump of 3000 m$^3$/h. Thus, the practical compression ratio of this molecular pump amounts to 6 for a pumping speed of 4800 l/sec under these operating conditions.

Naturally, the invention is not restricted to the above-described embodiments represented in the accompanying drawings; on the contrary, a number of other variants are possible, in particular as far as the configuration of the supports and the vibrating elements are concerned, used in the sealed box of this pump.

Thus, the support of a level could be formed of an open-worked plate on the surface of the latter, directed towards the outlet orifice 3, onto which are fixed the vibrating elements.

What is claimed is:

1. Molecular pump, which makes it possible to evacuate a gas from a chamber and to thus create a high vacuum, that comprises a substantially sealed box (1) having on one of its sides an intake orifice (2) to be connected to said chamber and, on the opposite side, an outlet orifice (3), to be preferably connected to a discharge pump, whereby elements (4) are mounted between those two orifices (2) and (3) at some distance from one another in substantially fixed sites inside said box (1) for the gas to pass through, said elements (4) being of such a nature as to impart to said gas molecules, coming from said chamber and coming into contact with said elements (4), a speed whereof the resultant is oriented towards the outlet orifice (3).

2. Pump according to claim 1, wherein the above-mentioned elements (4) are provided at successive levels, possibly grouped in level zones (12, 13, 14, 15, . . . ) between the intake orifices (2) and the outlet orifices (3) in such a way that they allow for the passage of the molecules from one level to the next, while being subjected, at each level, to an acceleration by the elements (4) of the latter towards the elements of the following level.

3. Pump according to claim 2, wherein the distance between the elements (4) of two successive levels decreases as of the intake orifice (2) towards the outlet orifice (3).

4. Pump according to claim 1, wherein the above-mentioned elements (4) are provided in a staggered manner.

5. Pump according to claim 1, wherein said elements (4) are mounted on a fixed support (5), on the side of the latter directed towards the above-mentioned outlet orifice (3), and co-operate with means (9) which make it possible to subject them to a vibration having a component directed towards the outlet orifice (3).

6. Pump according to claim 5, wherein means are provided to maintain the above-mentioned support (5) at a relatively low temperature, for example the ambient temperature.

7. Pump according to claim 6, wherein the support (5) and the box (1) are made of a caloric material and are mutually connected in a conductive manner, whereby the above-mentioned means for maintaining the support at a relatively low temperature comprise a cooling circuit (8) surrounding said box (1).

8. Pump according to claim 5, wherein the above-mentioned element (4) comprises a piezo-electric material (6) fixed to the above-mentioned support (5) and coated, on the side opposite to the one which is directed towards the support, with an electrically conductive coating (7), whereby means (9) are provided to apply an alternating current to said element (4), such that said piezo-electric material (6) is subjected to a deformation in a direction transversal to the support (5) and, consequently, said coating (7) is exposed to a corresponding vibration.

9. Pump according to claim 8, wherein the surface of the piezo-electric material (6) which makes contact with the support (5) and the coating (7) are put to earthgrounded.

10. Pump according to claim 8, wherein the piezo-electric material (6) is part of a flexible blade mounted on the support and which can undergo an elastic deformation as a result of the effect of the above-mentioned alternating current.

11. Pump according to claim 5, wherein the supports (5) are provided in a staggered manner and represent a cross section which strongly resembles an isosceles triangle whose top is directed towards the side of the box (1) in which is provided the intake orifice (2), whereby the inclination of the oblique sides (16) of these supports (5) allows for a reflection of the molecules which hit these sides towards the basis (17) of the supports (5) of the preceding level.

12. Pump according to claim 11, wherein the oblique sides (16) of the supports (5) are at least partially concave.

13. Pump according to claim 5, wherein the sides (16) of the supports (5) of a specific level directed towards the supports (5) of a preceding level are partially covered with elements (19) which can be subjected to a vibration having a component which is directed towards the elements (4) provided on the side (17) of the supports of the preceding level directed towards the outlet orifice (3), such that the kinetic energy of the molecules is increased following a series of collisions with the vibrating surfaces (7) of the elements (4) and (19) which face one another before they pass on to the next level.

14. Pump according to claim 8, wherein the piezo-electric material (6) is formed of quartz, Rochette salt ($NaKC_4H_4O_6NH_2O$), lithium sulphate ($Li_2SO_4H_2O$), lead methaniobate ($PbNb_2O_6$), lead titanate (PT), lead zirconate titanate (PZT), polyvinylidene fluoride (PVDF), polyvinylidene fluoride and trifluoro-ethylene copolymer (P(VDF-TrFE)), polyvinylidene fluoride and tetrafluoro-ethylene copolymer (P(VDF-TeFE)) or vinylidene cyanide and vinyl acetate copolymer (P(VDCN-VAC)).

15. Pump according to claim 3, wherein said rev elements (4) are provided in a staggered manner, said elements (4) are mounted on a fixed support (5), on the side of the latter directed towards the above-mentioned outlet orifice (3), and co-operate with means (9) which make it possible to subject them to a vibration having a component directed towards the outlet orifice (3).

16. Pump according to claim 7, wherein the above-mentioned element (4) comprises a piezo-electric material (6) fixed to the above-mentioned support (5) and coated, on the side opposite to the one which is directed towards the support, with an electrically conductive coating (7), whereby means (9) are provided to apply an alternating current to said element (4), such that said piezo-electric material (6) is subjected to a deformation in a direction transversal to the support (5) and, consequently, said coating (7) is exposed to a corresponding vibration.

17. Molecular pump, which makes it possible to evacuate a gas from a chamber and to thus create a high vacuum, that comprises a substantially sealed box (1) having on one of its sides an intake orifice (2) to be connected to said chamber and, on the opposite side, an outlet orifice (3), elements (4) being mounted between those two orifices (2) and (3) at some distance from one another on fixed supports (5) inside said box (1) for the gas to pass through, characterized in that said elements (4) are mounted on the fixed supports (5) on the side of the latter directed towards the outlet orifice (3), in such a way as to determine with these supports a succession of dipoles, whose active sides, formed by these elements, are also oriented towards the outlet orifice and to allow implying an acceleration of the gas molecules, coming from said chamber and coming into contact with these elements, towards the outlet orifice.

18. Pump according to claim 17, characterized in that said elements (4) co-operate with means (9) which make it possible to subject them to a vibration having a component directed towards the outlet orifice.

19. Pump according to claim 18, characterized in that the support (5) is made of a caloric and heat conducting material and is connected to a cooling circuit, this support (5) forming thus a cool part of a dipole, the element (4) being separated from this cool part by an insulator and thus forming a hot part of the dipole.

20. Pump according to claim 17, characterized in that the support (5) is made of a caloric and heat conducting material and is connected to a cooling circuit, this support (5) forming thus a cool part of a dipole, the element (4) being separated from this cool part by an insulator and thus forming a hot part of the dipole.

* * * * *